United States Patent [19]

Fleckenstein

[11] Patent Number: 4,943,270

[45] Date of Patent: Jul. 24, 1990

[54] PHOTOGRAPHIC PRINT CUTTER

[75] Inventor: Allen E. Fleckenstein, Bellevue, Wash.

[73] Assignee: CX Corporation, Seattle, Wash.

[21] Appl. No.: 426,522

[22] Filed: Oct. 24, 1989

Related U.S. Application Data

[63] Continuation of Ser. No. 170,677, Mar. 18, 1988, abandoned, which is a continuation of Ser. No. 903,544, Sep. 2, 1986, abandoned.

[51] Int. Cl.[5] ..... B26D 5/20

[52] U.S. Cl. ..... 493/10; 493/24; 493/29; 493/459; 83/106; 83/167; 83/209; 83/280; 83/365; 83/367; 162/271

[58] Field of Search ..... 83/102, 105, 106, 167, 83/371, 365, 367, 63-65, 209, 210, 211, 370, 279, 280; 493/10, 24, 29, 352, 459; 162/271

[56] References Cited

U.S. PATENT DOCUMENTS

| | | | |
|---|---|---|---|
| 1,691,023 | 11/1928 | Dye | 162/271 |
| 1,880,451 | 10/1932 | Hopkins . | |
| 3,757,619 | 9/1973 | Gianese | 83/365 X |
| 3,785,269 | 1/1974 | Morioka | 354/322 |
| 3,796,117 | 3/1974 | Mukai et al. | 83/365 X |
| 3,957,264 | 5/1976 | Bach et al. | 271/182 |
| 3,971,696 | 7/1976 | Manfredi | 162/271 |
| 4,095,084 | 6/1978 | Shutt | 83/365 X |
| 4,126,391 | 11/1978 | Nishimoto | 354/322 |
| 4,139,980 | 2/1979 | Larson et al. | 271/272 |
| 4,157,822 | 6/1979 | Miller | 271/3.1 |
| 4,221,144 | 9/1980 | Diesch et al. | 83/210 X |
| 4,255,994 | 3/1981 | Strunc | 83/371 |
| 4,277,061 | 7/1981 | Nagel et al. | 271/303 |
| 4,326,915 | 4/1982 | Mutschler, Jr. | 162/271 |
| 4,340,213 | 7/1982 | Jensen | 271/220 |
| 4,345,754 | 8/1982 | Willenbring | 271/220 |
| 4,416,450 | 11/1983 | van Wijingaarden . | |
| 4,534,253 | 8/1985 | Seragnoli | 83/371 |
| 4,655,067 | 4/1987 | Frost et al. | 83/365 X |
| 4,656,857 | 4/1987 | Tomita | 83/367 X |

*Primary Examiner*—Frank T. Yost
*Assistant Examiner*—Eugenia A. Jones
*Attorney, Agent, or Firm*—Christensen, O'Connor, Johnson & Kindness

[57] ABSTRACT

A print cutter suitable for use in an order finishing station or as a stand-alone unit includes a reel mount for accepting a reel of photographic prints formed in a continuous web. An automatic threader threads the leading end of the web through a loop guide into the first set of drive rollers. A leading end sensor senses the leading end of the web as it is automatically threaded through the loop guide to stop the threading process when the leading end of the web reaches the feed rollers. The same sensor is utilized to monitor the size of the loop of the print web present in the loop guide and to feed additional prints from the reel into the loop guide as required to maintain predetermined loop size. An accurate measure of print length is maintained by feeding the prints to the cutter using a roller pair including a nondeformable roller engaged with the undersurface of the prints and a deformable roller engaging the upper surface of the prints. The nondeformable roller is driven by a stepper motor. A decurling roller is provided which is pressed into contact with the upper surface of the prints after they have been cut to reverse bend the prints and remove the curl that is inherent in the prints due to their position on the circular reel. The decurler roll is adjustable to change the degree of reverse bend applied to the prints to accommodate varying amounts of curl. A diverter bar is swingably mounted on the print cutter adjacent the print exit to allow good prints to be deposited directly into a print tray, while makeover prints are held up above the good prints so that at the end of an order, the makeover prints are present at the top of the print stack.

6 Claims, 5 Drawing Sheets

PHOTOGRAPHIC PRINT CUTTER

This application is a continuation application based on prior copending application Ser. No. 170,677, filed on Mar. 18, 1988, now abandoned which is a continuation of application Ser. No. 903,544, filed on Sept. 2, 1986, now abandoned.

BACKGROUND OF THE INVENTION

This invention relates to photographic processing and handling equipment and, more particularly, relates to a print cutter for separating individual prints from a continuous reel, straightening the prints and sorting them.

Typically, in a commercial photofinishing lab, the photographic prints printed from developed film are batch processed and the prints are produced on a continuous reel. It is necessary to cut the prints into individual photographs from the reel prior to delivery of the prints to the customer. In order to process the prints in the most efficient manner, steps of the print cutting process are typically carried out in an automated machine. It is desirable to produce a print cutter that is easily threaded so that the prints from the reel can be presented to the knife of the cutter.

Because of their production in reel form, the prints tend to curl even after they are cut from the continuous reel since they have been conformed to the circular shape of the reel for some period of time. The curl of the prints makes it more difficult to stack them into a compact stack, easily insertable into an envelope for return to the customer. The customer also prefers the print to be flat, rather than curled, so that they are easier to put into a photo album or simply to look at. Present day print cutters have not really addressed the problem of straigtening or decurling the photographic prints after they are separated from the continuous reel and before they are delivered to the customer.

During the printing of the photographs, occasionally some of the photogaphs are damaged or do not turn out correctly and must be redone. These prints are marked by an inspector and designated makeover prints, meaning that that particular prints must be made again using the customer's film. It is desirable that after the prints are separated from the reel, any makeover prints are kept separated from the good prints that do not need to be made over so that the makeovers can be easily identified.

Optimally, all of the prints produced of any one type will be of uniform length. In order for the print cutter to accurately cut the prints to the desired length, it is necessary that the feed rollers that advance the prints through the cutter can be accurately monitored to determine the print length at the time of cutting.

It is, therefore, an object of the present invention to provide a print cutter for separating individual photographic prints from a continuous reel.

It is a further object of this invention to provide such a print cutter that automatically threads the continuous reel of prints into the cutter and continuously monitors the feed of the prints from the reel through the cutter.

It is another object of this invention to provide a print cutter that can accurately monitor the passing of the prints through the cutter to control the print length to desired accuracy.

It is a further object of this invention to provide a print cutter that removes the curl from the separated prints so that they are substantially flat at the time they are delivered to the customer.

It is another object of this invention to provide a print cutter that sorts the prints after separation from the reel into a satisfactory group and a group that needs to be made over.

SUMMARY OF THE INVENTION

In accordance with the above-stated objects, a photographic print cutter is provided which is operable to separate individual photographic prints from a continuous reel of prints. The print cutter includes a reel mounting means for rotatably mounting the continuous reel of prints on the print cutter. The print cutter further includes threading means for receiving an end of the continuous reel of prints and threading the end to a position from which it can be fed to the cutting knife. A print sensor is provided to monitor the position of the continuous reel of prints as it approaches the knife of the cutter to feed prints as necessary to maintain a steady flow of prints through the cutter. Preferably, the print cutter includes a print drive means including a nondeformable roller that underlies the prints on the nonimage side and a soft deformable roller that overlies the prints on the image side and cooperates with the nondeformable roller to produce a roller nip that engages the continuous prints and feeds them through to the knife. A monitoring means is associated with the nondeformable roller to monitor the rotation of the nondeformable roller in order to keep track of the length of the prints as they pass through the roller nip. The print cutter includes a knife operable to cut the prints to desired lengths, the knife being positioned downstream of the roller nip and ahead of a decurling means which produces a reverse bend in the print in order to remove the curl that is present due to the storage of the prints in circular reel form. Preferably, the decurling means is adjustable to produce a greater or lesser bend, depending on the initial bend of the photograph due to its position at the outer or inner circumference of the reel.

Downstream of the decurling means the print cutter includes a print tray that receives the prints after they have been cut and decurled. The print cutter of the present invention includes a makeover sorting means operable to separate the makeover prints from the good prints and deposit the prints into the print tray so that the makeover prints are always at the top of the stack of prints.

BRIEF DESCRIPTION OF THE DRAWINGS

The objects and advantages of the present invention will be better understood by those of ordinary skill in the art and others upon reading the ensuing specification when taken in conjunction with the appended drawings wherein.

DETAILED DESCRIPTION OF THE PREFERRED EMBODIMENT

Figure 1:
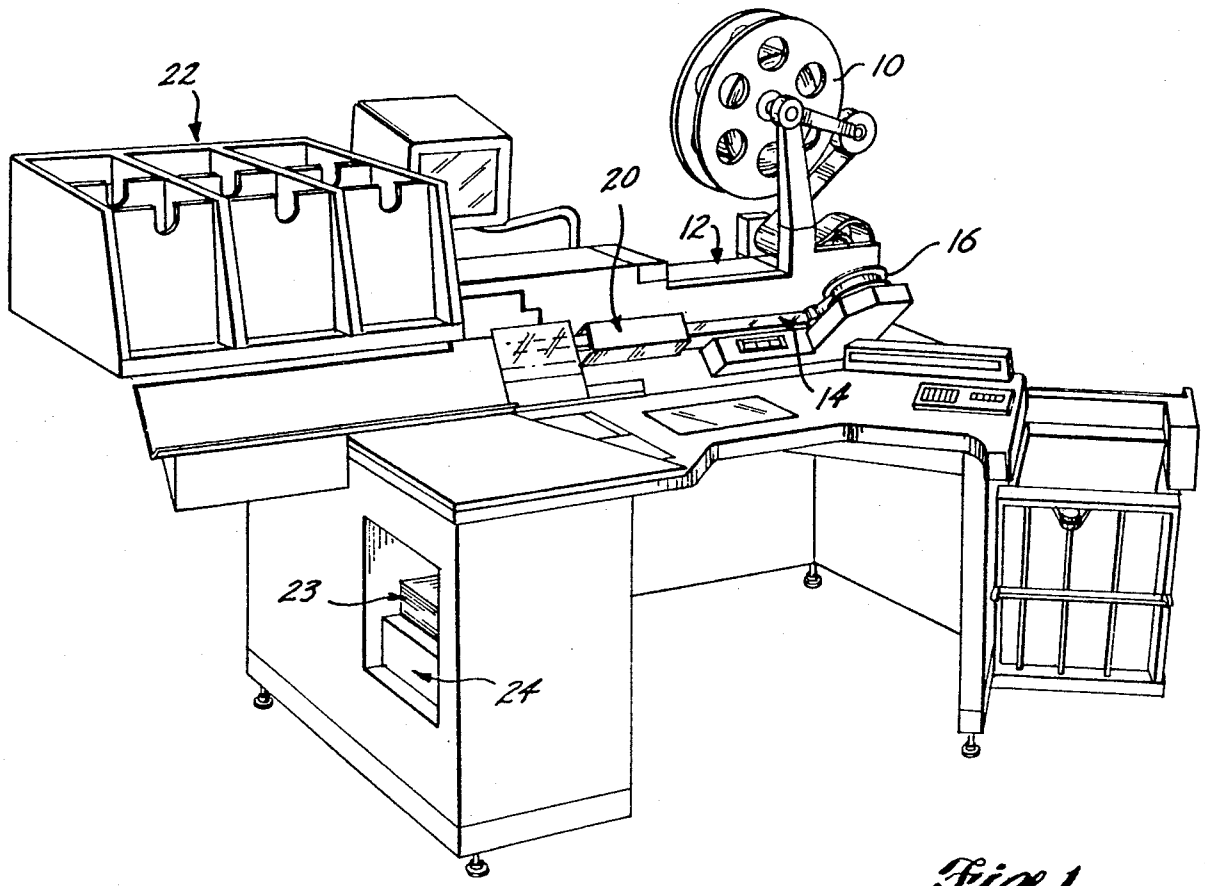
FIG. 1 is an isometric view of an order finishing station including a print cutter made in accordance with the principles of the present invention.

FIG. 1 shows an order finishing station which is the accumulating center for the parts of a photographic order prior to its return to the customer. A continuous reel of photographic prints 10 is mounted on a print cutter 12 which is included in the order finishing station. The station also includes a negative cutter 14 which receives a reel of developed film 16, separates the film into individual strips which are then stacked in a film stacker 20 and combined with the prints after they have been cut by the print cutter in wallets that are dispensed by a wallet dispenser 22, which is also a part of the order finishing station. The prints and negatives are placed into a customer envelope which is provided to the operator from a stack of envelopes 23 by an envelope feeder 24 located in the order finishing station. Using the information from the envelope along with the number of prints, the order is priced and prepared for return to the customer.

Figures 2, 3:
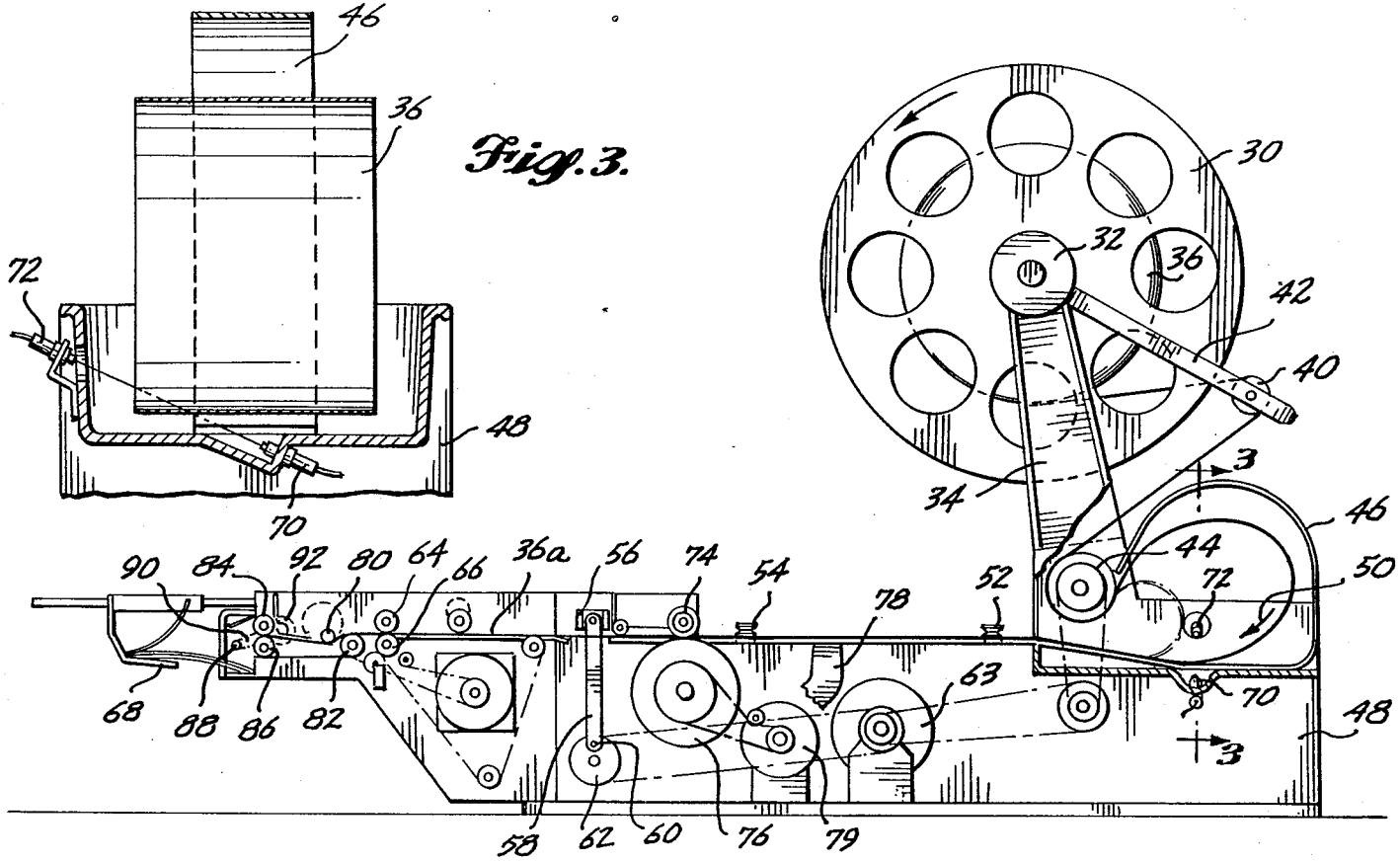
FIG. 2 is a side elevational view in somewhat schematic form of one embodiment of a print cutter made in accordance with the principles of the present invention.
FIG. 3 is a cross-sectional view along line 3—3 of FIG. 2 showing the print sensor means.

FIG. 2 illustrates a print cutter made in accordance with the principles of the present invention that can be used with the order finishing station of FIG. 1. A reel 30 is rotatably mounted on a hub 32 which is held above the print cutter by an arm 34. The reel 30 contains a continuous web 36 of photographic prints that have been received from the developing process. One end of the print web 36 is directed over a roller 40 held on a spring arm 42 which is swingably held on the hub 32. After the print web 36 passes over the roller 40, it passes under a feed roller 44 which is driven by a motor and has a gripping surface formed on it to drive the print web into a loop forming chamber defined by a curved plate 46 mounted on the print cutter base 48. As the driver roller 44 moves the prints through the loop chamber following the contour of the plate 46, as shown by the arrow 50, the end of the print web is engaged by a first pair of web guide rollers 52 which are vertically oriented and are slotted to provide a channel for the print web. A second pair of web guide rollers 54 identical to the first engages the print web and directs it towards a cutting knife 56. The knife 56 is a guillotine-type knife which moves up and down on a reciprocating arm 58 driven by a pin 60 extending from the knife control pulley 62 which is belt driven by a motor 63. As successive lengths of the print web 36 are fed beneath the guillotine knife 56, the knife control pulley 62 is rotated to drive the knife up and down, cutting predetermined lengths of the web corresponding to individual photographic prints. After separation from the rest of the web, the print **36*a* is engaged in the nip of a pair of print drive rollers 64 and 66 respectively which carry it towards a print receiving tray 68, where the prints are stacked until the end of an order when they are removed from the tray 68** by the operator for placement into an envelope for return to the customer.

In order to completely automate the process and thereby increase the efficiency with which the process is carried out, the print cutter has an automatic feed of the print web 36 through the loop chamber to form the loop and bring the end of the web 36 to the first pair web guide rollers 52. Once the operator places the web into engagement with the feed roller 44, the feed roller automatically continues to feed the web 36 around the loop plate 46. In order to stop the feed, a print sensor is provided which includes a photocell 70 and light source 72 operable to stop the drive motor. The position of the photocell 70 and the light source 72 are best seen in FIG. 3. The photocell 70 is positioned below the path of the web 36 through the loop chamber and is directed in an upward angle less than vertical. A hole in the bottom of the plate 46 permits the photocell 70 to detect light from the light source 72 located above the path of the print web 36 and to the side of the plate 46. Once the end of the web 36 passes between the light source 72 and the photocell 70, the photocell 70 sends a signal to a motor controller to stop the driver. A time delay is provided in line with the photosensor 70 and the motor controller so that once the leading end of the print web is detected, the motor will continue to drive for a predetermined period of time in order to carry the leading end to the first set of vertical web guide rollers 52. A typical time delay found to provide sufficient range was found to be between 10 and 200 milliseconds and the exact time delay must be adjusted prior to using the print cutter to provide sufficient delay, depending upon the type of paper and size of prints being fed through the print cutter. At times, it is necessary for the operator to assist in placing the leading end of the print web 36 into contact with the vertical web guide drive rollers 52. The first and second vertical web guide rollers 52 and 54 guide the web 36 to a pair of web drive rollers 74 and 76 that are driven separately from the feed roller 44 so that they continue to feed the print web through the cutter, even after the feed roller 44 has stopped. If the web drive rollers 74 and 76 pull enough of the print web through, the loop in the loop guide becomes smaller, as shown in the phantom lines in FIG. 2, until it again uncovers the photocell 70. When the photocell 70 is uncovered, a signal is sent to the motor controller and the feed roller is started up to drive more of the print web 36 from the reel 30 into the loop chamber to again assume the approximate shape of the solid line of FIG. 2. Again, the time delay allows sufficient looping to occur and the exact time must be set by the operator prior to using the print cutter.

Preferably, a bar code reader 78 is provided below the path of the print web 36 and scans the print web as it crosses the bar code reader to read a bar coded identification code affixed to the backside of the prints. This identification code is used to check on the match between the prints and the photographic negatives and envelopes that are passing through the order finishing station at the same time.

Since the cutter is dealing in photographic prints, it is necessary to take care of the image bearing side of the print so that the image is not scratched or damaged. Therefore, it has been found best to utilize soft rollers to contact the image bearing side of the film when feeding it through the print cutter. The roller 74 is a soft roller positioned above the path of the prints and is kept biased against the nondeformable roller 76 located below the print web to form a nip which grabs the print web and carries it through the cutter. The nondeformable roller 76 is driven by a stepper motor 79 which is stepped a precise number of steps in order to maintain length control over the individual prints as they pass through the knife of the cutter. By using the nondeformable roller 76, a more accurate length control can be made than through use of a deformable roller and, yet, by using the deformable roller 74 on the image bearing surface of the print, the print quality is maintained.

Figure 5:
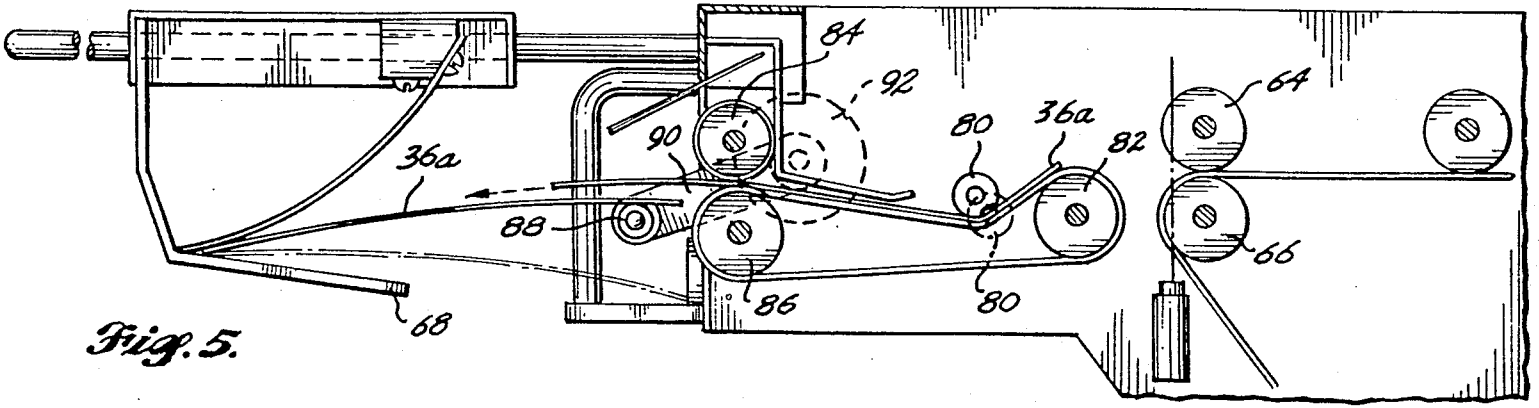
FIG. 5 is a side elevational view of a portion of the print cutter of FIG. 4 with the print sorter in the "make-over print" position.
Figure 6:
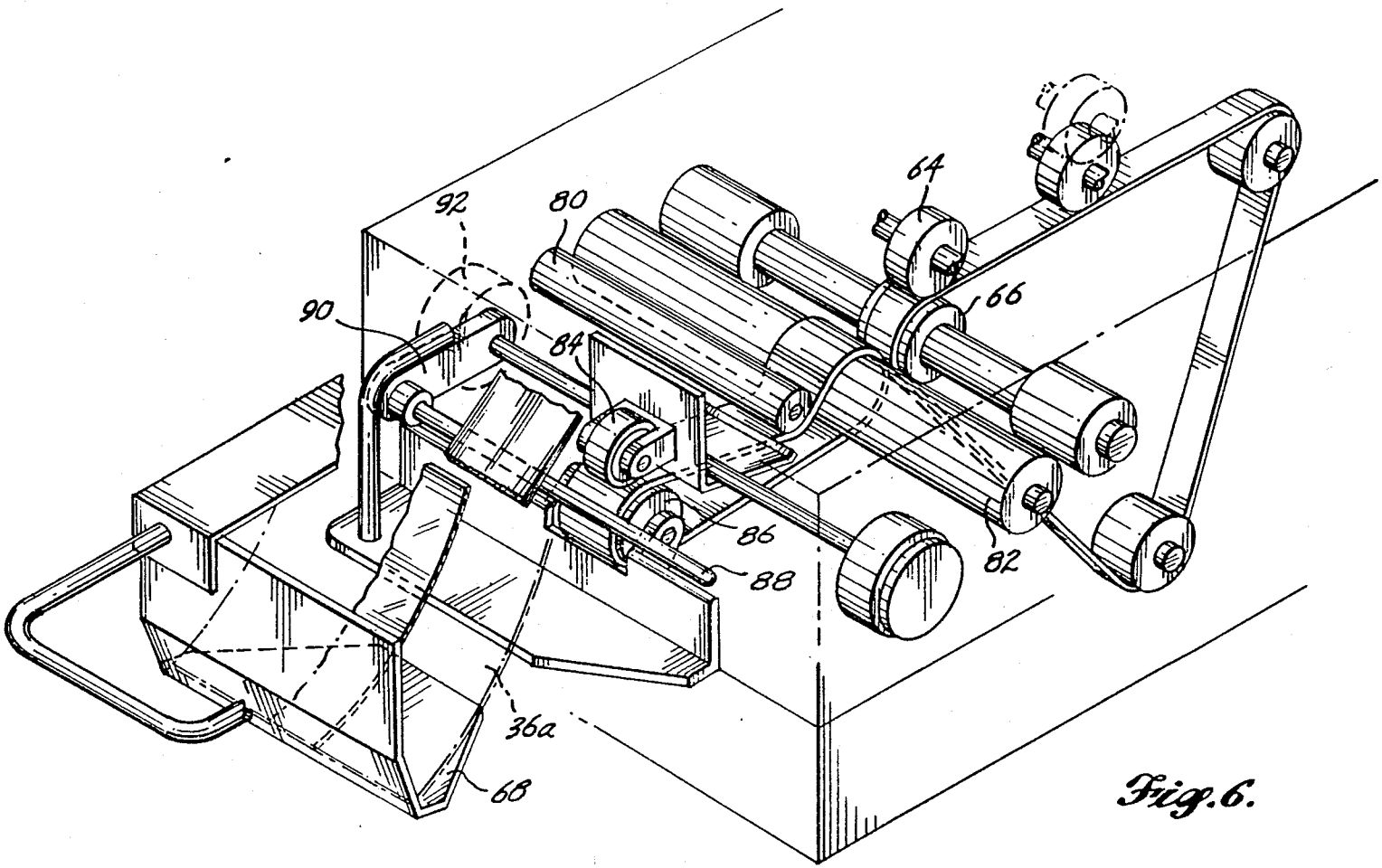
FIG. 6 is an isometric view of the print cutter shown in FIGS. 4 and 5.
Figure 7:
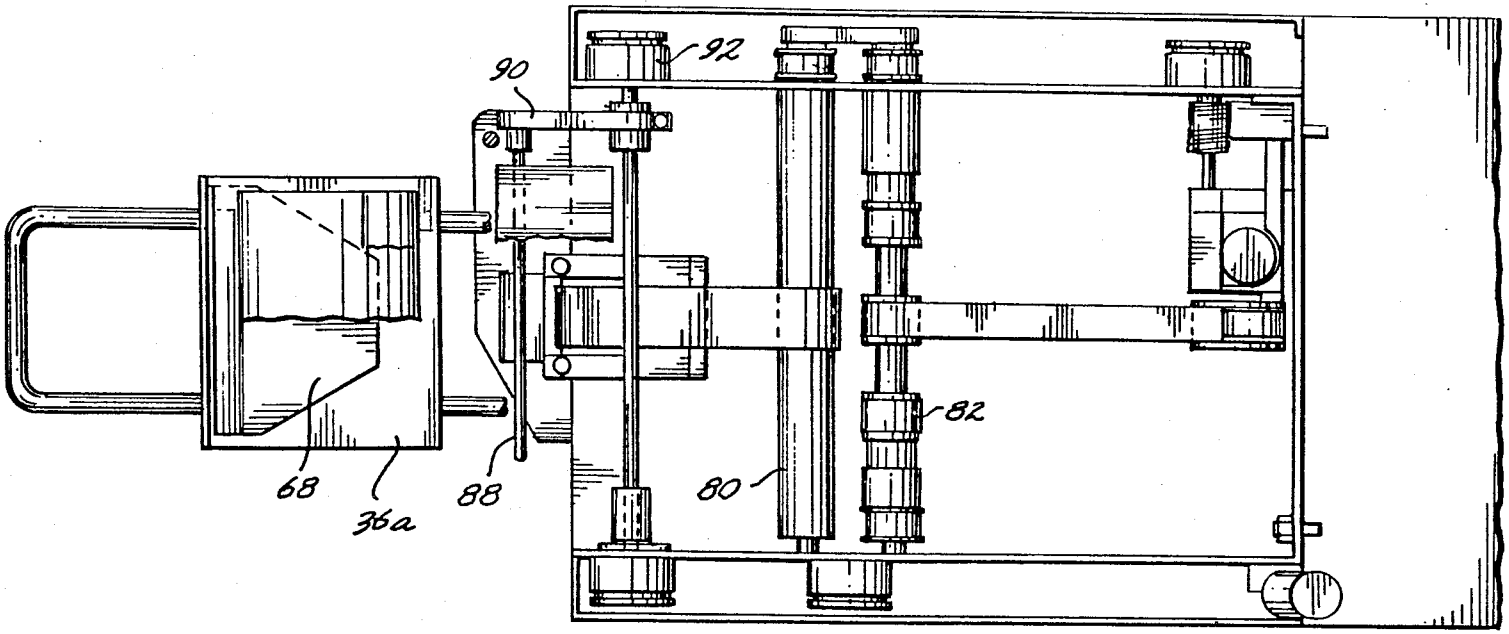
FIG. 7 is a plan view of the portion of the print cutter shown in FIGS. 4 and 5.

As discussed above, the prints, after they are separated from the continuous web 36, tend to curl because of their storage in a looped condition on the continuous reel. In order to remove the curl from the prints and provide straightened, flat prints to the customer, the print cutter of the present invention includes a decurling means. The decurling means consists of a decurling roller 80 that is located above the prints and is brought into contact with the prints to produce a reverse bend in conjunction with roller 82 positioned below the prints. The position of the print in the reel 30, i.e., whether it is at the outer circumference or near the core of the reel, will determine the amount of curl inherently in the print. The more curl present in the print, the more reverse bend that must be applied in order to remove that curl. Therefore, the decurling roller 80 is linearly adjustable in a direction oblique to the print surface to produce a greater or lesser bend in the print. Two possible positions of the decurling roller 80 are shown in solid line and dotted line in FIG. 5. The adjustment of the roller 80 is accomplished manually by the operator moving it toward the dotted position if the print has not been decurled sufficiently and toward the solid line position if the print is being curled in the opposite direction.

Figure 4:
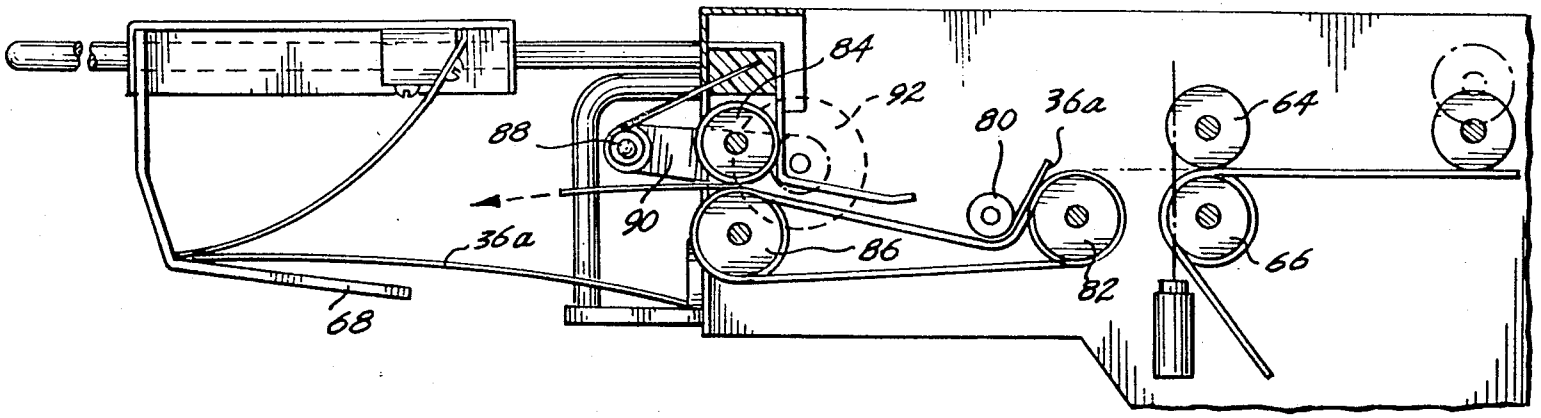
FIG. 4 is a side elevational view of a portion of the print cutter of FIG. 2 showing the print sorter in the "good print" position.

FIG. 4 shows the path of the print at the exit end of the print cutter. After passing beneath the decurling roll 80, the print 36*a* moves through a second pair of feed rolls 84 and 86 and is deposited into the print tray 68. As each print passes through the feed rolls 84 and 86, it is deposited on top of the preceding print in the print tray 68. Certain of the prints will need to be made over because there is some problem with the print image. Those prints will have been marked earlier. A diverter bar 88 is swingably mounted on an arm 90 attached to a rotary solenoid 92 which is operable in conjunction with the detection of a makeover mark on the print to rotate the solenoid 92 and the arm 90, bringing the bar 88 into its lowered position, as viewed in FIG. 5, so that prints passing through the feed rollers 84, 86 pass over the top of the bar 88. The print rests at one end in the print tray 68 and the other end of the print rests on the top of the diverter bar 88. As the diverter bar 88 is raised back up into its upper position, as shown in FIG. 4, the print is raised with it so that the next succeeding print will pass beneath the previous print. In this manner, each time a makeover print is sensed, the diverter bar 88 is lowered and the makeover print is carried on top of the diverter bar 88 so that at the end of the order, all of the makeover prints for that order are located above the good prints and can be easily separated out by the operator. The makeover mark can be sensed by any conventional means and the type of sensing used forms no part of the present invention.

In summary, therefore, a print cutter is provided which separates individual prints from a continuous web of prints formed into a reel. An automatic threader and feeder system is provided which includes a monitor to sense the leading end of the print web in order to control the automatic threading. The same sensor that senses the leading end of the print web also senses loop size and maintains loop control over the print web as the prints are fed through the print cutter. The print cutter provides accurate length control by utilizing a nondeformable feed roller driven by a stepper motor. In order to produce positive feed and yet not detrimentally affect the quality of the photographic image, the nondeformable feed roller is used on the underside of the print while a deformable pressure roller is utilized on the image face of the print to form a roller nip with the nondeformable roller that feeds the prints to the print cutter knife. The print cutter includes a decurling means which reverse bends the individual prints after they are cut to remove the curl inherent in the print due to its storage on a circular reel. Makeover prints are separated from good prints by a diverter bar which lifts the makeover prints above the good prints as they are sensed by the cutter so that at the end of an order, all of the makeover prints are at the top of the stack and all the good prints below them.

It should be noted that while a preferred form of the invention has been illustrated and described, changes can be made to that illustrated embodiment without exceeding the scope of the present invention. Therefore, the invention should be defined solely with reference to the appended claims.

The embodiments of the invention in which a property or privilege is claimed are defined as follows:

1. A print cutter for receiving a continuous web of photographic prints and cutting them into individual lengths comprising:

a base;

a track having a curved loop-forming portion mounted on said base, said web engaging said track and said loop-forming portion acting on said web to form said continuous web into a loop;

first drive means associated with said track for engaging said web and driving it in a first direction through said loop-forming portion;

second drive means associated with said track for driving said web in said first direction after it has passed through said loop-forming portion, said second drive means associated with said track operable independently of said first drive means;

cutter means mounted adjacent said track and spaced from said second drive means in said first direction;

a single sensor mounted adjacent said loop-forming portion for both sensing the passage of a leading end of said web through said loop-forming portion, and for detecting when the size of said loop of said web within said loop-forming portion is smaller than a predetermined size, said single sensor producing a stop drive signal when the leading end of the web is sensed to stop the first drive means when an end of said web reaches a first position, and said single sensor producing a start drive signal to start said first drive means when the size of said loop within said loop-forming portion is smaller than the predetermined size; and control means for controlling said first drive means in response to said stop drive and start drive signals from said single sensor, said control means including a time delay means in communication with said sensor to receive said stop drive signal, and in communciation with said first drive means to stop said first drive means a predetermined time after receiving said stop drive signal.

2. The print cutter of claim 1, wherein said second drive means includes:

a nondeformable roller rotatably mounted on said base;

a stepper motor drivingly connected to said nondeformable roller;

a deformable roller mounted adjacent said nondeformable roller; and biasing means associated with said deformable roller for biasing said deformable roller toward said nondeformable roller to form a roller nip which engages said print web as it exits said loop forming portion.

3. The print cutter of claim 1, wherein:

said cutter means is associated with said second drive means and operable in timed relation therewith to cut said print web into predetermined lengths; and further including decurling means associated with said drive means for reverse bending said prints after they have been cut to predetermined length by said knife means.

4. The print cutter of claim 3, wherein said decurling means includes a roller that contacts one surface of said prints after they are cut by said cutter means, and roller adjustment means for linearly moving said roller in a direction transverse to its axis of rotation.

5. The print cutter of claim 1, wherein:

said cutter means is associated with said print web and operable to cut said print web into predetermined lengths and further including;

third drive means for driving said cut lengths of prints from said cutter means;

a print tray for receiving said cut prints from said third drive means;

diverter means operable to change the path of said prints as they exit and said third drive means; and control means associated with said diverter means for controlling the operation of said diverter means to separate said prints into predetermined groupings.

6. The print cutter of claim 5, wherein said diverter means includes a bar spaced from said third drive means and movable between a first position in which said prints pass beneath said bar and a second position in which said prints pass on top of said bar, said bar being positioned in relation to said print tray so that at least a portion of said prints that pass over said bar rest on said bar as it moves between its first and second positions.

* * * * *

UNITED STATES PATENT AND TRADEMARK OFFICE

CERTIFICATE OF CORRECTION

PATENT NO. : 4,943,270

DATED : July 24 1990

INVENTOR(S) : Allen E. Fleckenstein

It is certified that error appears in the above-identified patent and that said Letters Patent is hereby corrected as shown below:

| Column | Line | |
|---|---|---|
| 1 | 37 | delete "straigtening" and insert therefor --straightening-- |
| 1 | 44 | delete "that" and insert therefor --the-- (second occurrence) |
| 3 | 43 | delete "driver" and insert therefor --drive-- |
| 4 | 17 | delete "driver" and insert therefor --drive-- |
| 6 | 16 | after "top of the" insert --print-- |
| 7 | 8 | delete "loop forming" and insert therefor --loop-forming-- |
| 7 | 17 | delete "knife" and insert therefor --cutter-- |

Signed and Sealed this

Twelfth Day of January, 1993

*Attest:*

DOUGLAS B. COMER

*Attesting Officer*

*Acting Commissioner of Patents and Trademarks*